US005281109A

United States Patent [19]

Bender

[11] Patent Number: 5,281,109

[45] Date of Patent: Jan. 25, 1994

[54] SHALLOW WELL PUMPING APPARATUS

[76] Inventor: E. A. Bender, 6625 Kane Way, Bakersfield, Calif. 93309

[21] Appl. No.: 8,558

[22] Filed: Jan. 22, 1993

[51] Int. Cl.[5] ..... F04B 17/00; F04B 35/04

[52] U.S. Cl. ..... 417/410 R; 417/415

[58] Field of Search ..... 417/410, 415

[56] References Cited

U.S. PATENT DOCUMENTS

| | | | |
|---|---|---|---|
| 2,601,198 | 6/1952 | Willson | 417/415 |
| 2,956,511 | 10/1960 | Morehead | 417/415 |
| 4,062,640 | 12/1977 | Gault | 417/415 |
| 4,086,035 | 4/1978 | Klaeger et al. | 417/415 |
| 4,368,909 | 1/1983 | Alexander, Jr. | 417/415 |
| 4,430,924 | 2/1984 | Dunn et al. | 91/277 |
| 4,512,149 | 4/1985 | Weaver | 60/371 |
| 4,530,645 | 7/1985 | Whatley et al. | 91/275 |
| 4,651,582 | 3/1987 | Bender | 417/415 |
| 4,761,120 | 8/1988 | Mayer et al. | 91/275 |
| 5,018,350 | 5/1991 | Bender | 60/369 |

FOREIGN PATENT DOCUMENTS

| | | | |
|---|---|---|---|
| 1421896 | 9/1988 | U.S.S.R. | 417/415 |

*Primary Examiner*—Richard A. Bertsch
*Assistant Examiner*—Alfred Basichas
*Attorney, Agent, or Firm*—Dennis B. Haase

[57] ABSTRACT

Shallow well pumping apparatus comprising a modified walking beam structure in which the beam itself is replaced by a tower intermediate a drive motor and the wellhead, wherein belting, capable of shock absorbtion, is employed as a shock absorbing motion translating and transmitting system for reciprocating a sucker rod to pump fluids from a subsurface deposit.

13 Claims, 2 Drawing Sheets

Fig. 1.
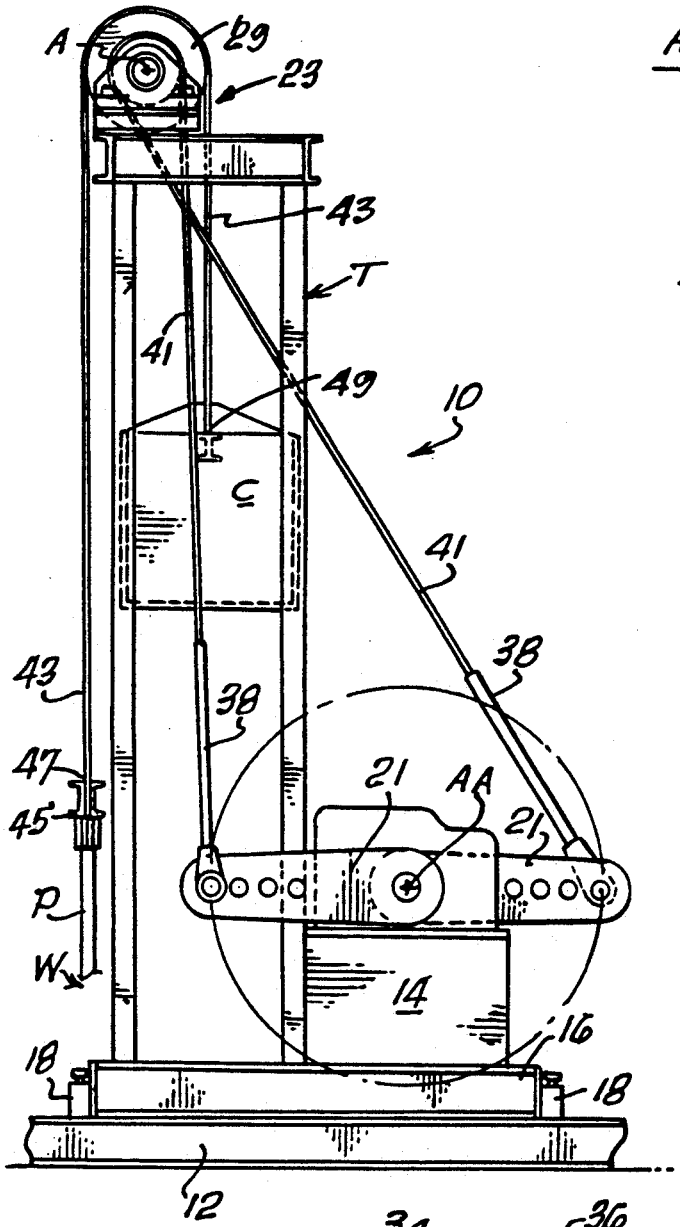
Fig. 2.
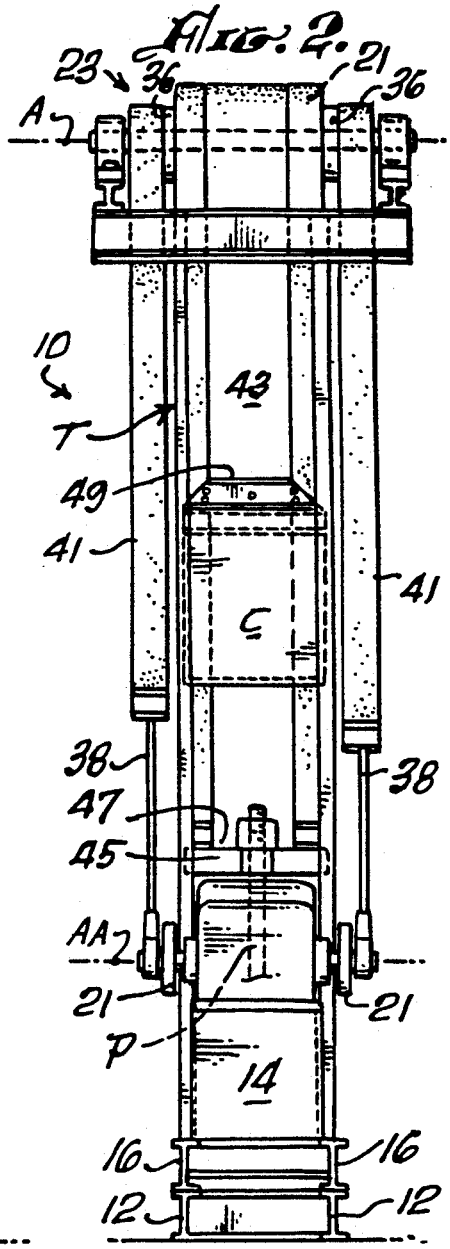
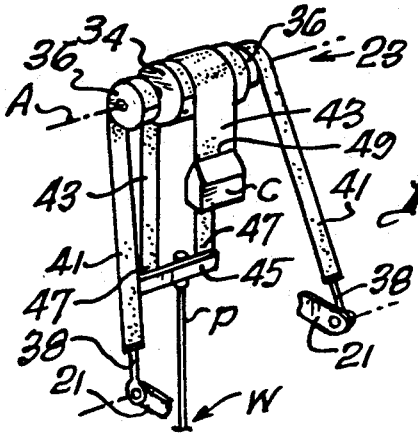
Fig. 3.

FIG. 4.
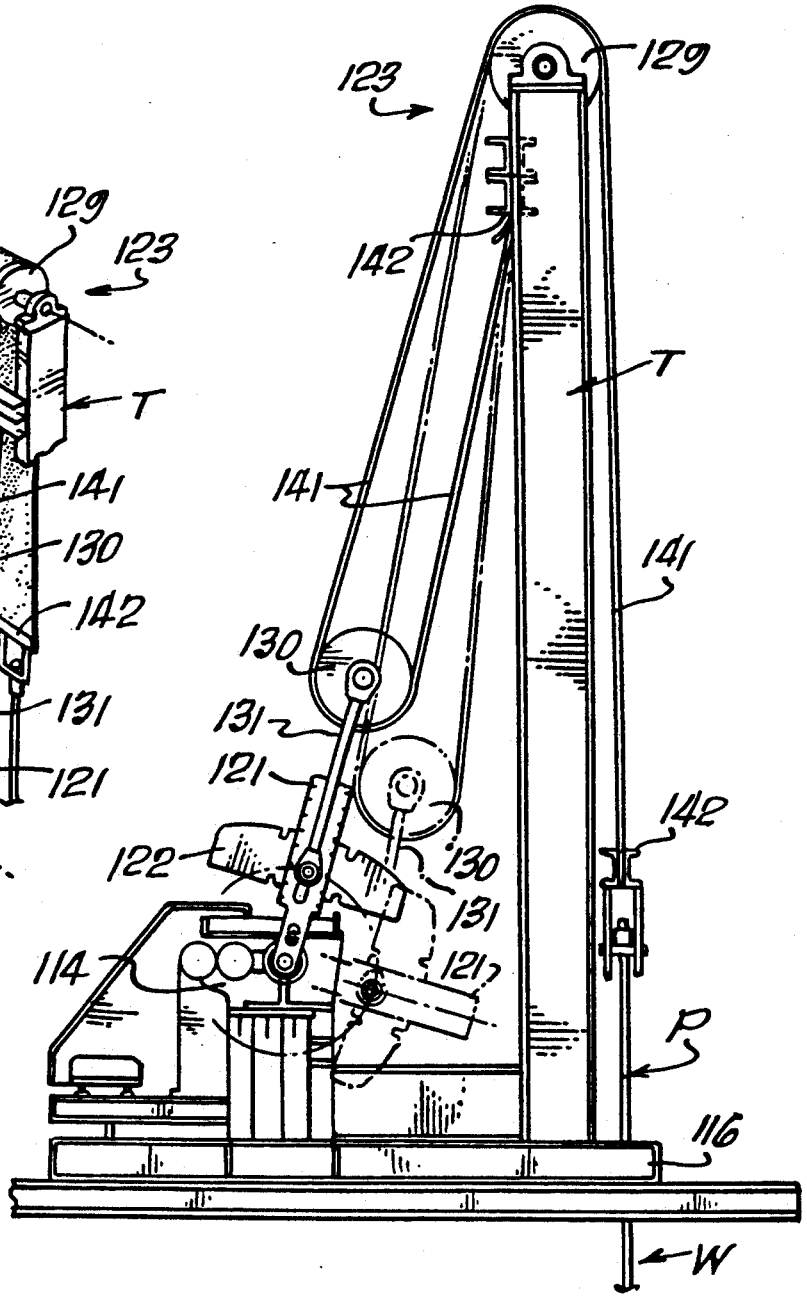
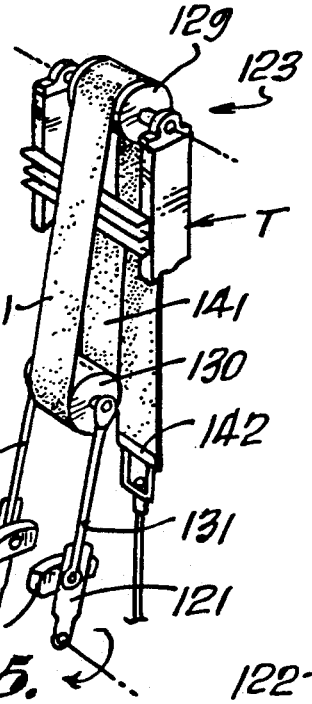
FIG. 5.

SHALLOW WELL PUMPING APPARATUS

The present invention relates generally to well pumping apparatus, primarily, although not exclusively, for use in the removal of oil, or other fluids from shallow subterranean wells, and more particularly to an improved device calculated to make the familiar and traditional "walking beam" type of pumping unit, obsolete.

BACKGROUND OF THE INVENTION

1. Field of the Invention

Constructors of well pumping apparatus, particularly in the oil fields, have developed equipment which can be acclimated to specific physiological conditions on situs. Of primary concern is the depth of the deposit to be recovered, and the industry has distinguished between "shallow" deposits ranging to a depth of 10,000 feet, and deposits below that range being, not surprisingly, designated as "deep".

Depth of the deposit is an obvious design parameter in that it is determinative of the length, and, thus, the weight of the column of fluid to be raised, which in turn directs the structural strength and power required.

As in any other commercial venture, the cost of doing business has a direct correlation to such factors as down time and costs of repair, and any improvements which results in a lessening of these negative factors inevitably results in a significant improvement in the "bottom line".

Reciprocating type pumps have received wide acceptance in cases where relatively viscous fluids are to be retrieved from subterranean deposits, as the most efficient for such purposes. This is so despite the problems inherent in such equipment when exposed to abrupt changes of direction under load. Such loading factors not only effect the useful life and maintenance schedule for such equipment, but the speed at which such equipment can be operated. Indeed, the operator must strike a meaningful balance between his desire to optimize profit by extracting the most product per unit of time, and the down time costs for maintenance.

In shallow well operations, the standard in the industry is commonly referred to as a "walking beam" pumping unit. Such units employ a powered gear reduction unit which is greatly over designed, simply to be able to withstand shock loading. The transmission drives rotating cranks, which in turn, causes a beam to oscillate about a fulcrum point. A forward end of the beam connects to a stringer to reciprocate the pump in the well.

In recognition of the inevitability of striking the compromise, as aforesaid, by virtue of the deficiencies in existing equipment, the present invention seeks to provide improvements in such equipment so as to permit the operator to overbalance that compromise in favor of profit, principally due to the fact of the 2.1 ratio or, in most cases, double the stroke of most walking beam units.

2. Overview of the Prior Art

One of the prime limiting factors in the performance of existing shallow well equipment is its ability to withstand rapid and repeated changes in loading for extended periods of operation. Virtually all elements of the unit structure are placed under great stress as the pump reaches the bottom of its stroke and begins upwardly. The simplistic answer to this quandary is to simply build the apparatus stronger. There are, however, practical limits, dictated to some extent by size, and to a large extent by cost, to the massiveness of the equipment. Those practical limits have been reached in the familiar walking beam pumping unit.

There have been several efforts to render the "walking beam" unit obsolete, as evidenced by Mayer U.S. Pat. No. 4,761,120. Mayer teaches the concept of substituting a hydraulic ram, which reciprocates on a slide instead of the gear reduction transmission currently in wide use. The ram drives a flexible chain, and uses complex set of hydraulic controls to sense and control movement of the pump stringer. The fallacy of this concept, and those akin to it, is that it is not adaptable, nor compatible with the vast amount of existing equipment, end it is a start from scratch approach. As will be apparent, the "beam" itself is used to translate the rotary motion of the power unit, to the reciprocating motion needed at the well head, and the prior art solution to this translation is to employ reciprocating power, such as the ram, in the first instance. Weaver U.S. Pat. No. 4,512,149 is a variation on the same theme.

Whatley U.S. Pat. No. 4,530,645 presents yet another hydraulic/chain drive combination, and to a limited extent, Bender U.S. Pat. No. 5,018,350 is of interest in that belting is used between the source of motive power and the sucker rod. Bender is, of course, a deep well application, and as in the other relevant art, relies on hydraulic power in a totally different environment, than the present invention.

SUMMARY OF THE INVENTION

The present invention seeks to provide a profit strained industry with a novel means of adapting its existing shallow well equipment to minimize shock loading, with all of its attendant problems.

More specifically, it is one of the objectives of the present invention to provide a modified pumping unit which eliminates the "beam" itself, while providing improved performance over the well known "walking beam" configuration, and which has a greatly increased period of uninterrupted operation, and as an adjunct thereto, longer periods between scheduled maintenance.

Another objective achieved by the present invention is the ability to use, efficiently, much of the equipment currently available and in use, with very little modification, which, by virtue of its "over design", is capable of faster, and, thus, more profitable, operation than possible with the "beam" in place.

Finally, it is an objective of the present invention to provide an improved shallow well pumping unit which is of such size, that it is readily transportable from site to site with an absolute minimum of teardown and set up time.

The foregoing, as well as other significant objectives and advantages, will become apparent from a further reading of the specification, read in conjunction with the accompanying drawings, wherein:

THE DRAWINGS

FIG. 1 is a side elevation of one embodiment of an improved pumping apparatus of the present invention, adaptable to a gear reduction transmission which Includes opposed radially outwardly extending crank arms;

FIG. 2 is an end view of the embodiment of FIG. 1, illustrating certain other features of the present invention, FIG. 3 is a pictorial view, in perspective, of the belting arrangement of FIG. 1, illustrating the operative features thereof;

FIG. 4 illustrates the application of the invention to a gear reduction transmission having parallel radially outwardly extending arms, and FIG. 5 is a pictorial view, similar in nature to FIG. 3, illustrating the operative features of the embodiment of FIG. 4.

DESCRIPTION OF PREFERRED EMBODIMENTS

With reference now to the drawings, and initially to FIG. 1, a "walking beam" type pump apparatus, or unit, 10 is illustrated, which has been modified in accordance with the present invention.

The entire unit is removably secured to cellar straddle beams 12, ad in the illustrated form, comprises a drive motor, which include an electrical or engine powered gear reducer transmission 14, resting on base beams 16, positioned and secured to the cellar straddle beams 12, by means of skid jacks, 18. The transmission 14 is intended to be typical of those used in existing "walking beam" apparatus, and differs from the FIG. 4 configuration primarily in the position of the drive cranks and counterweights. As seen in the FIG. 1 configuration, the drive cranks comprise opposed, radially outwardly extending arms 21.

The present invention contemplates the modification of an existing "walking beam" unit by elimination of the beam from which the unit derives its name, while retaining the heart of the unit, namely the drive motor, and providing a new and novel shock absorbing, motion translating and transmitting, system 23.

In order to provide proper alignment and balance, the motion transmitting system includes a tower T, suitably formed by a series of vertically disposed beams 25 tied and structurally supported by horizontal tying beams 27.

The tower T is disposed immediately adjacent the well head W, from which a polish rod P, extends, and is supported on the base beams 66. A sucker rod extends down the vertical well shaft to a pump (not shown), all of which is referred to herein from time to time, collectively, as simply the pump. At the apex of the tower T is a drum 29, supported in pillow blocks 32. The axis of rotation A of the drum is aligned and coplaner with the axis AA of rotation of the crank arms 21.

In keeping with another aspect of the invention, rotation of the cranks in either a clockwise or counter clockwise direction, as seen in FIG. 1, is translated and transmitted, by means of the motion system 23, into alternate and successive rotations and counter rotations of the drum 29, which motion is coincidentally multiplied and transmitted to the polish rod P, in the form of reciprocal motion.

As best seen in FIG. 3, the drum 29 is segmented to provide a central, relatively larger diameter segment 34, flanked by relatively smaller segments 36. Each smaller diameter segment is coplaner with a crank arm. Crank arms 21 are connected by means of cables 38, to the motion system 23, which includes drive belts 41. The other end of the drive belts are affixed to the smaller diameter drum segments 36. In order to attain the desired rotation of the drum, the left hand belt (as seen in FIG. 2) is wound on the drum segment 36 in a counter clockwise direction, while the right segment is wound in a clockwise direction. Thus, as the crank arms rotate, the drive belts will alternately wind and unwind on the drum segments, in substantially equal time segments, causing the drum to rotate first in one direction and then in the other.

In accordance with the invention, the rotary motion of the drum, 29, is applied to the polish rod by means of a driven belt 43, as part of the system 23, and is affixed to the polish rod P by means of a polish rod carrier 45 at one end, 47 thereof. The belt 43, which is preferably made of a PolyVINLOX interwoven high tensile material, is draped over and frictionally engaged with the central drum segment 34, from which it depends, within the framework of the tower T, to a counterweight C, which attaches to the belt end 49. The counter weight, in keeping with the invention, balances the weight of the polish rod, attached sucker rod, and pumping apparatus, thereby reducing the load on the belts to that of the pumping loads. The counterweight rides within, and may be guided within the framework of the tower T, in a known manner.

The belting provides the apparatus of the present invention with an all weather means of shock absorption, previously unheard of in shallow well equipment, while making optimum use of existing expansive parts, such as the drive motor. It will be appreciated that the width and thickness of the belting may vary in accordance with the loads to be anticipated.

A previously unappreciated benefit of the present configuration is the ability to increase both the speed and stroke of the pumping unit, while, surprisingly, increasing reliability and lowering maintenance. For example, the use of the segmented drum is made possible, thereby permitting the stroke of the pump to be increased, in an amount proportionate to the relative circumferences of the segments 34 and 36. Similarly, the drive motor, which is typically over designed to handle shock loads, can be run at higher speeds without increase in wear, because shock loading is significantly reduced by the belting.

The same inventive concepts are applicable to "walking beam" type units in which the counterweights are disposed upon the crank arms, and the arms themselves are parallel, rather than opposed configuration just discussed.

With reference now to the configuration of FIG. 4, the transmission 114 drives a pair of radially outwardly extending parallel crank arms 121. Each crank arm is affixed with counterweights 122, the position of which is adjustable along the arms 121, in a known manner.

As in the case of the FIG. 1 configuration, a motion transmission and translation system 123 is provided in cooperation with a tower T affixed to base beams 116, and positioned adjacent to the well head, W.

The motion transmission system 123, best illustrated in FIG. 5, includes a drive drum 130, rotatably affixed to the free ends 131 of the crank arms 121. A driven drum 129 is rotatably mounted to the apex of the tower T, and both drums are axially aligned.

The motion system, 123 includes belting 141, which is secured at one end, 142, to the framework of the tower T, from which it is extended downwardly and about the drive drum 130, thence upwardly to engage the driven drum, 129. The free end 142, depends downwardly to engage the polish rod P, as previously described with respect to the FIG. 1 configuration.

As the crank arms 121 are rotated by the transmission 114, the belting causes reciprocation of the polish rod, as is apparent in FIG. 5.

The configuration thus described has all of the salutary features attributable to the FIG. 1 embodiment. Again, of course, existing equipment has been modified to make it faster more efficient, and far less susceptible to damage due to shock loading.

Moreover, both configurations are compact and readily transportable from site to site with a minimum of set up and tear down time.

Having thus described the invention in two configurations,

What is claimed is:

1. A pumping unit operable to extract fluids from a shallow subsurface deposit through a vertically disposed well shaft, comprising in combination:

pump means passing through said shaft and into said deposit, a drive motor, crank arms attached to said drive at one end thereof, said crank arms being rotatable by said motor about a common axis of rotation, a tower, said tower being disposed intermediate said drive motor and the vertically disposed shaft, a drum disposed on said tower, said drum having an axis of rotation parallel to said common axis of rotation of said parallel arms, a shock absorbing motion translating and transmitting system, including belt means, said belt means being affixed, at one end thereof, to said pump means, said belt means engaged by said crank arms, and engaging said drum to thereby move said belt means in a reciprocating motion it said pump means.

2. The apparatus asset forth in claim 1, wherein said crank arms are parallel to one another.

3. The apparatus as set forth in claim 1, wherein said crank arms are opposed radially outwardly extending, coaxial, and rotatable in the same direction.

4. A pumping unit operable to extract fluids from a shallow subsurface deposit through a vertically disposed well shaft, comprising in combination:

pump means passing through said shaft and into said deposit;

a drive motor;

parallel crank arms attached to said drive motor at one end thereof, said parallel crank arms being rotatable by said drive motor about a common axis of rotation, a tower, said tower being disposed adjacent to said drive motor, a drum disposed on said tower, said drum having an axis of rotation parallel to said common axis of rotation of said parallel arms, a shock absorbing motion translating and transmitting system including belt means, said belt means being affixed, at one end thereof to said pump means, and at the other end to said tower, said belt means engaged by said crank arms, and engaging said drum to thereby move said belt means in a reciprocating motion at said pump means.

5. The apparatus as set forth in claim 4, wherein means defining a roller disposed at the end of said crank arm opposite the drive end, and said belt means extending about, and in engagement with said roller, such that when said crank arms are rotated, said belt means reciprocates said pumping means.

6. The apparatus as set forth in claim 4, wherein said crank arms include counterweights, said counterweights being selectively positionable thereon.

7. The apparatus as set forth in claim 5, wherein said crank arms include counterweights, said counterweights being selectively positionable thereon.

8. A pumping unit operable to extract fluids from a shallow subsurface deposit through a vertically disposed well shaft, comprising in combination:

pump means passing through said shaft and into said deposit;

a drive motor, opposed radially outwardly extending crank arms attached to said drive motor, said radially outwardly extending crank arms being rotatable by said drive motor about a common axis of rotation a tower, said tower being disposed intermediate said drive motor and said well shaft a drum disposed on said tower, said drum having an axis of rotation parallel to said common axis of rotation of said radially outwardly extending arms a shock absorbing motion translating and transmitting system including belt means connected to said crank arms and engaging sid drum such that said drum is rotated as said crank arms are rotated, and further including a second belt means being connected between said drum and said pumping means to reciprocate said pumping means as the crank arms rotate.

9. The apparatus as set forth in claim 8, wherein said drum includes a central relatively large diameter segment, and having relatively smaller diameter segments flanking said larger diameter segment, each of said smaller diameter segment being coplaner with one of said crank arms.

10. The apparatus as set forth in claim 9, wherein said motion system includes a belt interconnecting each said crank arm and a coplaner smaller diameter segment, and further including belting interconnecting said larger diameter segment and said pumping means.

11. The apparatus as set forth in claim 10, wherein said crank arms are so attached to said smaller segments as to cause said drum to rotate in one direction for a predetermined time, and thereafter to reverse its direction of rotation for an equal time, thereby reciprocating said pump means.

12. The apparatus as set forth in claim 9, wherein said motion system includes a driven belt, said driven belt being engaged with the larger diameter segment of said drum, and said driven belt being attached to counter weights at the other end thereof.

13. The apparatus as set forth in claim 12, wherein said counter weights are contained and reciprocated within said tower.

* * * * *